US005110488A

United States Patent [19]

Tipton et al.

[11] Patent Number: 5,110,488

[45] Date of Patent: May 5, 1992

[54] LUBRICATING COMPOSITIONS CONTAINING REDUCED LEVELS OF PHOSPHORUS

[75] Inventors: Craig D. Tipton, Perry; Thomas A. Tagliamonte, Mentor, both of Ohio

[73] Assignee: The Lubrizol Corporation, Wickliffe, Ohio

[21] Appl. No.: 437,331

[22] Filed: Nov. 17, 1989

Related U.S. Application Data

[63] Continuation of Ser. No. 933,830, Nov. 24, 1986, abandoned.

[51] Int. Cl.[5] ..... C10M 137/06

[52] U.S. Cl. ..... 252/32.7 E; 252/49.6; 252/49.9; 252/51.5 A

[58] Field of Search ..... 252/32.7 E, 49.6, 51.5 A, 252/49.9

[56] References Cited

U.S. PATENT DOCUMENTS

| | | | |
|---|---|---|---|
| 3,017,361 | 1/1962 | Morris et al. | 252/35 |
| 3,087,936 | 4/1963 | Le Suer | 260/326.3 |
| 3,172,892 | 3/1965 | Le Suer et al. | 260/326.5 |
| 3,254,025 | 5/1966 | Le Suer | 252/32.7 |
| 3,367,869 | 2/1968 | Silver et al. | 252/35 |
| 3,390,082 | 6/1968 | Le Suer et al. | 252/32.7 |
| 3,489,682 | 1/1970 | Le Suer | 252/32.7 |
| 3,539,513 | 11/1970 | Forbes et al. | 252/37.2 |
| 3,640,872 | 2/1972 | Wiley et al. | 252/75 |
| 3,779,928 | 12/1973 | Schlicht | 252/75 |
| 3,868,330 | 2/1975 | Meinhardt et al. | 252/33.6 |
| 3,915,871 | 10/1975 | Bryer et al. | 252/33.6 |
| 3,932,290 | 1/1976 | Koch et al. | 252/49.8 |
| 3,944,495 | 3/1976 | Wiley et al. | 252/75 |
| 4,005,159 | 1/1977 | Koch et al. | 260/953 |
| 4,210,542 | 7/1980 | Mann | 252/32.7 E |
| 4,234,435 | 11/1980 | Meinhardt et al. | 252/51.5 A |
| 4,308,154 | 12/1981 | Clason et al. | 252/32.7 E |
| 4,428,849 | 1/1984 | Wisotsky | 252/33.4 |
| 4,466,895 | 8/1984 | Schroeck | 252/32.7 E |
| 4,474,674 | 10/1984 | Gutierrez | 252/47.5 |
| 4,579,666 | 4/1986 | Schroeck | 252/32.7 E |
| 4,582,618 | 4/1986 | Davis | 252/32.7 E |

FOREIGN PATENT DOCUMENTS

| | | |
|---|---|---|
| 1142195 | 2/1969 | United Kingdom . |
| 1195041 | 6/1970 | United Kingdom . |

OTHER PUBLICATIONS

N. E. Gallopoulos and C. K. Murphy "ASLE Transactions", 14, 1-7, (1971).

F. G. Rounds, "ASLE Transactions", 21, 91-101 (1978).

K. Inoue and H. Watanabe, "ASLE Transactions", 26, 189-199 (1983).

"Automotive Engineering", 93, 50-58 (1985).

*Primary Examiner*—Prince Willis, Jr.

*Assistant Examiner*—Ellen McAvoy

*Attorney, Agent, or Firm*—Joseph P. Fischer; Frederick D. Hunter; James L. Cordek

[57] ABSTRACT

Lubricating compositions containing up to about 0.015% by weight of phosphorus. These compositions comprise oil, metal salts of phosphorus-containing acids having at least one secondary hydrocarbon substituent, a boron-containing acylated nitrogen-containing compound and optionally an acylated nitrogen-containing compound and/or a zinc salt of a carboxylic acid. The lubricating oil compositions are useful in various application including engine oils, power transmission fluids, including automatic transmission fluids, functional fluids and the like.

25 Claims, No Drawings

LUBRICATING COMPOSITIONS CONTAINING REDUCED LEVELS OF PHOSPHORUS

This is a continuation of copending application Ser. No. 06/933,830 filed on Nov. 24, 1986, now abandoned, which disclosure is hereby incorporated by reference in its entirety.

FIELD OF THE INVENTION

This invention relates to lubricating compositions containing up to about 0.015% by weight phosphorus. The lubricating compositions of this invention include, but are not limited to, engine oils, power transmission fluids, particularly automatic transmission fluids, functional fluids and the like.

BACKGROUND OF THE INVENTION

Lubricating compositions comprising oil of lubricating viscosity and combinations of zinc dithiophosphates and ashless dispersants are known. It has been commonly accepted in the lubricating oil art that high levels of phosphorus, often about 0.1% by weight phosphorus in the finished lubricating oil, are necessary to provide adequate antiwear or antioxidant performance. When phosphorus content is reduced, it has been necessary to provide other additives to compensate for the loss of protection normally provided by phosphorus. Recently, environmental and toxicological problems associated with the use of organo phosphorus compounds have become a matter of serious concern. The presence of high levels of phosphorus in engine oils used to lubricate internal combustion engines has been suspected of contributing to inactivation of catalytic converters used to control emissions from gasoline engines. Additionally, high levels of phosphorus frequently interfere with performance in certain applications. For example, it has been observed that a high level of zinc dithiophosphate adversely affects transmission cooler solder corrosion. Furthermore, efficient utilization of resources is desirable, both to conserve resources and to reduce costs. It is of interest, then, that lubricating compositions be developed which employ additives containing reduced levels of increasingly scarce and costly raw materials, and materials which are suspected of contributing to environmental and toxicological problems. It is, of course, necessary that such lubricating compositions provide acceptable performance, particularly with respect to dispersancy, antioxidancy and antiwear.

U.S. Pat. No. 3,390,082 (Le Suer, et al) relates to lubricants containing an oil-soluble acylated amine wherein the acyl group is illustrated by a relatively high molecular weight substituted succinic group having at least about 50 carbon atoms in the substituent, and a phosphorus-containing substance such as a metal phosphorodithioate or adduct thereof with an epoxide.

U.S. Pat. No. 3,254,025 (Le Suer) relates to oil-soluble nitrogen and boron-containing compositions, combinations thereof with group II metal phosphorodithioates and lubricants for internal combustion engines, gears and power transmitting units.

U.S. Pat. No. 4,308,154 (Clason, et al) relates to mixed metal salts of dialkylphosphorodithioic acids and carboxylic acids, which are useful in lubricants and functional fluids as antioxidants and extreme pressure agents having improved thermal stability.

U.S. Pat. No. 4,582,618 (Davis) describes lubricating oil compositions containing less than about 0.1% by weight of phosphorus. These lubricating compositions comprise a major amount of an oil of lubricating viscosity and a minor amount of at least one oil-soluble sulfur-containing material which comprises the reaction product of sulfur and a Diels-Alder adduct in a molar ratio less than 1.7:1 wherein the adduct is an adduct of a dieneophile with at least aliphatic conjugated diene.

SUMMARY OF THE INVENTION

The present invention provides lubricating compositions containing reduced levels of phosphorus, that is, up to about 0.015% by weight of phosphorus and preferably up to about 40 parts per million of phosphorus.

Another object of this invention is to provide reduced phosphorus containing lubricating oil compositions that provide adequate antiwear and antioxidant performance without employing any substantial amount of any other additive as a substitute for phosphorus-containing additives.

Still another object is to provide novel power transmission fluids that meet multiple performance specifications.

A further object is to provide a low phosphorus lubricating oil composition which meets both automatic transmission fluid and power shift transmission fluid specifications.

These and other objects of this invention can be accomplished by preparing a lubricating composition containing up to about 0.015% by weight of phosphorus which comprises (A) a major amount of an oil of lubricating viscosity, (B) at least one metal salt selected from the group consisting of (I) metal salts of the formula

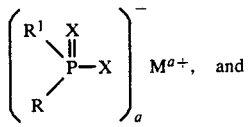

(II) metal salts $M_b^{a+}\ Y^{-}{}_a$ of a mixture of (1) at least one acid of the formula

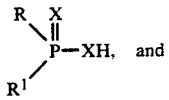

(2) at least one carboxylic acid having the formula $R^2COOH$ wherein $R^2$ contains from about 2 to about 40 carbon atoms and is an aliphatic or alicyclic hydrocarbon-based radical, each $Y^-$ is independently an anion of acids (1) or (2), M is a metal, a is the valence of the metal M, b is a number between 0.5 and 2, P is phosphorus, each X is independently oxygen or sulfur, and R and $R^1$ are the same or different hydrocarbon groups of at least 3 carbon atoms bonded to the phosphorus, at least one bond being at a secondary carbon atom of R or $R^1$, directly or through an oxygen or sulfur atom, and (C) from about 0.005% to about 0.02% by weight boron as at least one acylated, nitrogen-containing compound made by reacting an aliphatic hydrocarbon substituted carboxylic acylating agent having at least about 10 carbon atoms in the aliphatic hydrocarbon substituent, simultaneously or sequentially, in any order, with at least one amino compound containing at least one $$-\overset{|}{N}H$$

group and a boron-containing reagent, provided further (B) the metal salt is the major source of phosphorus in the lubricating composition.

These and other objects of this invention can also be accomplished by providing a lubricating composition comprising up to 0.015% by weight of phosphorus which comprises a combination of components (A), (B) and (C) as mentioned hereinabove and described in detail hereinafter with (D) at least one acylated, nitrogen-containing compound having a total base number up to about 80, made by reacting an aliphatic hydrocarbon substituted carboxylic acylating agent having at least about 10 carbon atoms in the aliphatic hydrocarbon substituent with at least one amino compound containing at least one $$-\overset{|}{N}H$$

group, said acylating agent being linked to said amino compound through an imido, amido, amidine or acyloxy ammonium linkage.

The low phosphorus containing compositions of this invention reduce the severity of, or completely eliminate, corrosion and other problems associated with the use of lubricating oils containing higher levels of phosphorus.

DETAILED DESCRIPTION OF THE PREFERRED EMBODIMENTS

The lubricating oil compositions of the present invention contain up to about 0.015% by weight of phosphorus, and more generally about 40 parts phosphorus per million parts by weight of lubricating oil composition.

The term "hydrocarbon-based group" is used throughout this specification and in the appended claims to denote a group having a carbon atom directly attached to the remainder of the molecule and having predominantly hydrocarbon character within the context of this invention. Such groups include the following:

(1) Hydrocarbon groups; this is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, the two indicated substituents may together form a cyclic group). Such groups are known to those skilled in the art; examples include methyl, ethyl, butyl, hexyl, octyl, decyl, dodecyl, tetradecyl, octadecyl, eicosyl, cyclohexyl, phenyl and naphthyl (all isomers being included).

(2) Substituted hydrocarbon groups; that is, groups containing non-hydrocarbon substituents which, in the context of this invention, do not alter predominantly hydrocarbon character of the group. Those skilled in the art will be aware of suitable substituents (e.g., halo, hydroxy, alkoxy, carbalkoxy, nitro, alkylsulfoxy).

(3) Hetero groups; that is, groups which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based group.

(A) The Oil of Lubricating Viscosity

The lubricating oil compositions of the present invention comprise a major amount of oil of lubricating viscosity, including natural and synthetic lubricating oils and mixtures thereof.

Natural oils include animal oils and vegetable oils (e.g. castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins, etc. and mixtures thereof, alkylbenzenes, polyphenyls (e.g., biphenyls, terphenyls, alkylated polyphenyls, etc.), alkylated diphenyl ethers and ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, sebacic acid, etc.) with a variety of alcohols (e.g., butyl alcohol, dodecyl alcohol, ethylene glycol, diethylene glycol monoether, etc.)

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants. Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the compositions of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, hydrorefining, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Specific examples of the above-described oils of lubricating viscosity are given in Chamberlin III, U.S Pat. No. 4,326,972 and European Patent Publication 107,282, both of which are hereby incorporated by reference for relevant disclosures contained therein.

As noted hereinabove, the lubricating compositions of this invention include, among others, engine oils and power transmission fluids, including hydraulic fluids, power shift transmission fluids and automatic transmission fluids. The specific types and characteristics of oils of lubricating viscosity for the various applications are well known in the art.

(B) The Metal Salts

Component (B) includes the metal salts of the group I metals, the group II metals, aluminum, tin, cobalt, lead, molybdenum, manganese, nickel, titanium, iron and antimony, as well as mixtures of two or more of those metals. Preferred Group I metals are sodium, potassium and copper. Preferred Group II metals are magnesium, calcium, barium and zinc. Especially preferred salts are those of zinc. Metal salts used in the lubricating composition of this invention are selected from the group consisting of (I) metal salts of the formula (I)

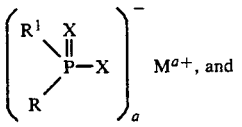

$M^{a+}$, and (II) metal salts of the formula $M_b^{a+}\ Y_a^-$ which is a salt of at least two acidic components of which component (B)(II)(1) is at least one acid of the formula

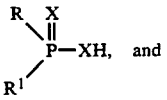

and component (B)(II)(2) is at least one carboxylic acid having the formula $R^2COOH$ wherein $R^2$ contains from about 2 to about 40 carbon atoms and is an aliphatic or alicyclic hydrocarbon-based radical and each element in the above formulae is as defined hereinabove. As mentioned hereinabove, at least one of R and $R^1$ is bonded at a secondary carbon atom to the phosphorus atom, directly or through oxygen or sulfur. Preferably, the bonding of both R and $R^1$ is at a secondary carbon atom. Mixtures of metal salts (B)(I) and (B)(II) are also contemplated. If such mixtures are employed, components (B)(I) and (B)(II) are preferably present at ratios ranging from 30:1 to 1:30 parts by weight.

The acids used in the preparation of the metal salts employed in the lubricating compositions of this invention, and the metal salts themselves are prepared by methods well known in the art.

Typical phosphorus-containing acids from which the metal salts employed in this invention may be prepared include, but are not limited to:

1. Dihydrocarbylphosphinodithioic acids corresponding to the formula,

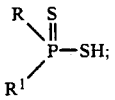

2. S-hydrocarbyl hydrogen hydrocarbylphosphonotrithioates corresponding to the formula,

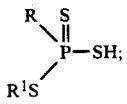

3. O-hydrocarbyl, hydrogen hydrocarbylphosphondithioates corresponding to the formula,

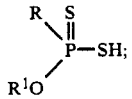

4. S,S-dihydrocarbyl hydrogen phosphorotetrathioates corresponding to the formula,

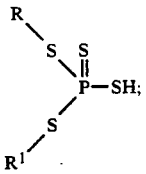

5. O,S-dihydrocarbyl hydrogen phosphorotrithioates corresponding to the formula,

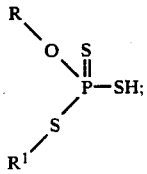

6. O,O-dihydrocarbyl hydrogen phosphorodithioates corresponding to the formula,

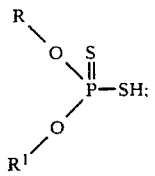

7. Mixtures of O-hydrocarbyl hydrogen phosphates corresponding to the formula, $$(RO)_x-\overset{\overset{\displaystyle O}{\|}}{P}-(OH)_y$$

wherein x equals 1 or 2, y equals 1 or 2 and x plus y equals 3.

The preparation of these acids is well known in the art and is described in the patent literature and numerous other texts and publications. See for example the books, "Lubricant Additives," by C. V. Smallheer and R. K. Smith, published by Lezius-Hiles Co., Cleveland, Ohio (1967) and "Lubricant Additives," by M. W. Ranney, published by Noyes Data Corp., Parkridge, N.J. (1973), and the following U.S. Pat. Nos.:

| | | |
|---|---|---|
| 2,261,047 | 3,211,648 | 3,402,188 |
| 2,540,084 | 3,211,649 | 3,413,327 |
| 2,838,555 | 3,213,020 | 3,446,735 |
| 2,861,907 | 3,213,021 | 3,502,677 |
| 2,862,947 | 3,213,022 | 3,573,293 |
| 2,905,683 | 3,213,023 | 3,848,032 |
| 2,952,699 | 3,305,589 | 3,859,300 |
| 2,987,410 | 3,328,298 | 4,002,686 |
| 3,004,996 | 3,335,158 | 4,089,793 |
| 3,089,867 | 3,376,221 | 4,123,370 |
| 3,151,075 | 3,390,082 | 4,308,154 |
| 3,190,833 | 3,401,185 | 4,466,895 |
| | | 4,507,215 |

These books and patents are hereby incorporated by reference for relevant disclosures contained therein.

Preferred acids of the general formula $$[(RO)_2\overset{\overset{\displaystyle S}{\|}}{P}SH]$$

are readily obtainable from the reaction of phosphorus pentasulfide ($P_2S_5$) and an alcohol. The reaction involves mixing at a temperature of about 20° to about 200° C., 4 moles of the alcohol with one mole of phosphorus pentasulfide. Hydrogen sulfide is liberated in this reaction. The oxygen-containing analogs of these acids are conveniently prepared by treating the dithioic acid with water or steam which, in effect, replaces 1 or both of the sulfur atoms. The mixed phosphates $$(RO)_x\overset{\overset{\displaystyle O}{\|}}{P}(OH)_y$$

are readily prepared by reacting 3 moles of an alcohol with 1 mole of phosphorus pentoxide ($P_2O_5$).

The preferred phosphorus-containing acids are phosphorus- and sulfur-containing acids. These preferred acids more preferably include those wherein at least one X is sulfur, more preferably both of X are sulfur; at least one of R and $R^1$ is bonded to the phosphorus through an oxygen or sulfur atom, more preferably both R and $R^1$ are bonded to the phosphorus through oxygen.

As noted hereinabove, the terminology of "hydrocarbon-based group" as used herein with respect to R and $R^1$ is used to define a substantially saturated monovalent radical derived from a hydrocarbon by removal of a hydrogen from a carbon atom of the hydrocarbon. This carbon atom is directly bonded to the remainder of the molecule. At least one of R and $R^1$ is bonded at a secondary carbon atom. The hydrocarbon-based groups may be straight chains, e.g., isopropyl-, n-pentyl-, sec-butyl-, etc. or branched, e.g., 2-methyl-4-pentyl-, isooctyl-, etc. As noted hereinabove, at least one of R and $R^1$ must be a secondary hydrocarbon group.

The terminology "substantially saturated" as used herein is intended to define radicals free from acetylenic unsaturation (—C≡C—) in which there is not more than one ethylenic linkage (—C=C—) for every 10 carbon-to-carbon (preferably 20) covalent bonds. The so-called "double bonds" in aromatic rings (e.g., benzene) are not to be considered as contributing to unsaturation with respect to the terminology "substantially saturated". Usually there will be no more than an average of one ethylenic linkage per substantially saturated monovalent radical as described hereinbefore. Preferably, (with the exception of aromatic rings) all the carbon-to-carbon bonds in a substantially saturated radical will be saturated linkages; that is, the radical will be free from acetylenic and ethylenic linkages.

In general, the hydrocarbon-based radical may contain at least 3 carbon atoms and up to about 100 carbon atoms with a preferred range from 3 to about 40 carbon atoms, more preferably from about 3 to about 16 carbon atoms. Other preferred ranges are from about 6 to about 18 carbons, more preferably from about 6 to about 8 carbons. Mixtures wherein R and $R^1$ are different are useful. Typical examples of R and $R^1$ include isopropyl-, n-butyl-, n-pentyl-, 4-methyl-2-pentyl-, isooctyl-, n-dodecyl-, etc. Mixtures, such as isopropyl- and isooctyl, sec-butyl and n-decyl-, isopropyl- and 4-methyl-2-pentyl- and the like are useful. Mixtures are often statistical mixtures which comprise a mixture wherein some of the molecules have both R and $R^1$ alike and additional molecules wherein R and $R^1$ are different.

The hydrocarbon-based radicals may contain certain nonreactive or substantially non-reactive polar or non-hydrocarbon substituents which do not materially interfere with the reactions or compositions herein, as will be recognized by those skilled in the art. Representative non-hydrocarbon or polar substituents include halo substituents, nitro, lower alkoxy, lower alkylthio, hydroxy, mercapto, and the like. As a general rule, and particularly when the compositions of this invention are to be used as lubricant additives, the degree of substitution and nature of the substituent of the hydrocarbon-based radical is such that the predominantly hydrocarbon character of the radical is not destroyed. Thus, these radicals normally have no more than 4 substituents and usually not more than 1 substituent for every 10 carbon atoms in the radical. Preferably, the hydrocarbon-based radical is purely hydrocarbyl (a hydrocarbon radical containing only carbon and hydrogen atoms).

The term lower when used herein to denote radicals such as lower alkyl is intended to describe a radical containing up to 7 carbon atoms.

Methods for preparing the metal salts (B)(I) are well known and are described in detail in the patent literature. Most frequently, the salts are prepared by reacting one or more of the phosphorus-containing acids described hereinabove with a metal base. Suitable metal bases include the free metals previously enumerated and their oxides, hydroxides, alkoxides and basic salts. Examples include sodium hydroxide, calcium hydroxide, zinc oxide, copper oxide, calcium acetate and the like. Other methods include "double-decomposition" reactions wherein one metal salt of a phosphorus acid is reacted with a salt, such as a halide, of another metal. Metal exchange may take place. For example, a sodium dithiophosphate can be reacted with calcium chloride to form a calcium dithiophosphate and sodium chloride. Sodium chloride is then removed by means commonly used in the art, such as filtration, water washing, etc. These and other methods are described in the books and U.S. Patents listed hereinabove which describe the method of preparation of the various phosphorus acids. Each of the above-listed books and patents is hereby incorporated by reference for disclosures relating to the preparation of the metal salts.

Also contemplated for use in the lubricating compositions of this invention are metal salts of phosphorus-containing acids as described hereinabove, which have been post-treated with other reagents to improve various properties. Examples include post-treatments with phosphites, epoxides, amines and the like. Such post-treatments and products so obtained are described in the following U.S. Pat. Nos.:

| | |
|---|---|
| 3,004,996 | 3,213,022 |
| 3,151,075 | 3,213,023 |
| 3,211,648 | 4,263,150 |
| 3,211,649 | 4,289,635 |
| 3,213,020 | 4,507,215 |
| 3,213,021 | |

As noted hereinabove, the metal salts useful in the lubricating compositions of this invention may be (B)(II)

$$M_b^{a+} Y_a^-$$

wherein the various elements of the formula are as described hereinabove.

The metal salts (B)(II) are salts of at least two acidic components. The phosphorus-containing acids (B)(II)(1) have been described hereinabove.

The carboxylic acid reactant (B)(II)(2), employed in the preparation of component (B)(II) may be a monocarboxylic or polycarboxylic acid, usually containing from 1 to about 3 carboxy groups and preferably only 1. It may contain from about 2 to about 40, preferably from about 2 to about 20 carbon atoms, and advantageously about 5 to about 20 carbon atoms. The preferred carboxylic acids are those having the formula $R^2COOH$, wherein $R^2$ is an aliphatic or alicyclic hydrocarbon-based radical preferably free from acetylenic unsaturation. Suitable acids include acetic, propionic, butanoic, hexanoic, decanoic, dodecanoic, octadecanoic and eicosanoic acids, as well as olefinic acids such as acrylic, oleic, linoleic, and linoleic acid dimer. For the most part, $R^2$ is a saturated aliphatic radical and especially a branched alkyl radical such as the isopropyl or 3-heptyl radical. Illustrative polycarboxylic acids are oxalic, malonic, succinic, alkyl- and alkenylsuccinic, glutaric, adipic, pimelic, sebacic, maleic, fumaric and citric acids.

Component (B)(II) may be prepared by merely blending a metal salt of component (B)(II)(1) with a metal salt of component (B)(II)(2) in the desired ratio. This ratio is between about 0.5:1 and about 500:1 on an equivalent basis. Preferably, the ratio is between about 0.5:1 and about 200:1. Advantageously, the ratio can be from about 0.5:1 to about 100:1, preferably from about 0.5:1 to about 50:1, and more preferably from about 0.5:1 to about 20:1. Further, the ratio can be from about 0.5:1 to about 4.5:1, preferably about 2.5:1 to about 4.25:1. For this purpose, the equivalent weight of a phosphorus containing acid (B)(II)(1) acid is its molecular weight divided by the number of acidic groups ,and that of a carboxylic acid is its molecular weight divided by the number of carboxy groups therein. The information required to determine equivalents can usually be determined from the structural formula of components (B)(II)(1) and (B)(II)(2) or empirically through well known titration procedures.

A second and preferred method for preparing the metal salts of mixtures of acids (B)(II)(1) and (B)(II)(2) is to prepare a mixture of the acids in the desired ratio and to react the acid mixture with a suitable metal base. When this method of preparation is used, it is frequently possible to prepare a neutral salt or a salt containing an excess of metal with respect to the number of equivalents of acid present; thus, mixed metal salts containing as many as 2 equivalents and especially up to about 1.5 equivalents of metal per equivalent of acid may be prepared. The equivalent of a metal for this purpose is its atomic weight divided by its valence.

The term "neutral salt" refers to salts characterized by metal content equal to that which would be present according to the stoichiometry of the metal and the particular organic compound reacted with the metal. Thus, if a phosphorodithioic acid, $(RO)_2PSSH$, is neutralized with a basic metal compound, e.g., zinc oxide, the neutral metal salt produced would contain one equivalent of zinc for each equivalent of acid, i.e., $[(RO)_2PSS]_2Zn$.

However, component (B)(II) can contain more or less than the stoichiometric amount of metal. The products containing less than the stoichiometric amount of metal are acidic materials. The products containing more than the stoichiometric amount of metal are overbased materials. Component (B)(II) may have about 80% to about 200%, preferably about 100% to about 150%, more preferably about 100% to about 135%, and advantageously about 103% to about 110% of the metal present in the corresponding neutral salt.

Variants of the above-described methods may also be used to prepare the mixed metal salts of this invention. For example, a metal salt, component (B)(II) may be blended with the free acid as component (B)(II)(2), and the resulting blend reacted with additional metal base.

Suitable metal bases for the preparations of the metal salts (B)(II) of this invention include the free metals previously enumerated and their oxides, hydroxides, alkoxides and basic salts. Examples are sodium hydroxide, sodium methoxide, sodium carbonate, potassium hydroxide, potassium carbonate, magnesium oxide, magnesium hydroxide, calcium hydroxide, calcium acetate, zinc oxide, zinc acetate, lead oxide, nickel oxide, copper oxide, antimony trioxide and the like.

The temperature at which the metal salts used in this invention are prepared is generally between about 30° and about 150° C., preferably up to about 125° C. If component (B)(II) is prepared by neutralization of a mixture of acids with a metal base, it is preferred to employ temperatures above about 50° and especially above about 75°. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using component (B) in the composition, concentrates and functional fluids of the invention.

As mentioned hereinabove, and as illustrated by the numerous references incorporated herein which describe the metal salts of phosphorus-containing acids, the metal salts and derivatives thereof are well known in the art. The following examples are provided to illustrate several of the metal salts useful as component (B) in this invention. It is emphasized that these examples are provided for illustrative purposes and are not to serve as a limitation on the scope of the invention.

EXAMPLE 1

One mole of an O,O-di(alkyl)phosphorodithioic acid containing 40 mole % isopropyl and 60 mole % 4-methyl-2-pentyl group is reacted with an oil slurry of 1.08 equivalents (0.54 moles) of zinc oxide at about 190° F. (88° C.). $H_2O$ is evolved. The reaction mixture is steam stripped followed by vacuum stripping. Oil is added if necessary to adjust the phosphorus content of the residue to about 9.5%. The oil solution is filtered.

EXAMPLE 2

The procedure of Example B-1 is repeated employing 1 mole of di(4-methyl-2-pentyl)dithiophosphoric acid and 1.1 equivalents (0.55 moles) of an oil slurry of zinc oxide. The filtered product contains 8.5% phosphorus.

EXAMPLE 3

The procedure of Example B-2 is repeated except no oil diluent is employed. The filtered product contains 9.25% phosphorus.

EXAMPLE 4

A mixture of 67 parts (1.63 equivalents) of zinc oxide and 48 parts of mineral oil is mixed at room temperature. A mixture of 303 parts (1 equivalent) of the O,O-di(alkyl)phosphorodithioic acid described in Example 2 and 36 parts (0.25 equivalents) of 2-ethylhexanoic acid is added over 10 minutes and a slight exotherm is observed. When addition is complete, the temperature is increased to 80° C. for 3 hours. The mixture is vacuum stripped at 100° C. and filtered.

Additional representative examples of metal salts useful as component (B) in the compositions of this invention appear in the patents and publications herein incorporated by reference. Other examples will occur to one skilled in the art.

(C) The Boron-containing Acylated Nitrogen Compound

Component (C) includes boron-containing acylated amines. In particular, component (C) is at least one acylated, nitrogen-containing compound made by reacting an aliphatic hydrocarbon substituted carboxylic acylating agent having at least about 10 carbon atoms in the aliphatic hydrocarbon substituent, simultaneously or sequentially, in any order, with at least one amino compound containing at least one $$-\overset{|}{N}H$$

group and a boron-containing reagent.

The carboxylic acylating agents include aliphatic hydrocarbon substituted aliphatic, cycloaliphatic and aromatic mono- and polybasic carboxylic acylating agents having at least about 10 carbon atoms in the aliphatic hydrocarbon substituent. These acylating agents include acids, anhydrides, halides and esters, all of which are or can produce the desired acylating agent. Specific examples include, but are not limited to, substituted succinic, phthalic, propionic, salicylic, tartaric, phenoxyacetic, and the like. The number of carbon atoms in the hydrocarbon substituent of the acylating agent may vary over a wide range provided that the boron-containing acylated nitrogen-containing compound is soluble in the lubricating composition of the present invention. Thus, the hydrocarbon substituent generally will contain at least about 10 carbon atoms, preferably an average of at least 30 carbon atoms and often an average of at least about 50 carbon atoms. In addition to oil solubility considerations, other performance considerations will dictate the lower limit on the average number of carbon atoms in the substituent. Determination of the necessary carbon number to attain a particular performance level or performance characteristic is within the skill of the worker having ordinary skill in the art.

The hydrocarbon substituent of the acylating agent may contain polar groups as indicated above, and, providing that the polar groups are not present in proportions sufficiently large to significantly alter the hydrocarbon character of the substituent.

The sources of these substantially hydrocarbon substituents include mono-olefins of at least about 10 carbon atoms, olefin oligomers and high molecular weight substantially saturated petroleum fractions and substantially saturated olefin polymers, particularly polymers of mono-olefins having from 2 to 30 carbon atoms. Mono-olefins particularly useful as sources of the substantially hydrocarbon substituent include decenes, octadecenes, eicosenes and the like. The especially useful polymers are the polymers of 1-mono-olefins, such as ethylene, propene, isobutene, 1-octene, 2-methyl-1-heptene and 2-methyl-5-propyl-l-hexene. Polymers of medial olefins, i.e, olefins in which the olefinic linkage is not at the terminal position, likewise are useful. They are illustrated by 2-butene, 3-pentene and 4-octene.

Also useful are the interpolymers of the olefins such as those illustrated above with other interpolymerizable olefinic substances, such as aromatic olefins, cyclic olefins and polyolefins. Such interpolymers include, for example, those prepared by polymerizing isobutene with styrene; isobutene with butadiene; isobutene with chloroprene; isoprene with p-methyl styrene; 1-hexene with 1,3-hexadiene; isobutene with styrene and piperylene; and ethylene with propylene and 1,4-hexadiene; etc.

The use of olefin polymers having molecular weights (Mn) of about 700–10,000 is preferred. Higher molecular weight olefin polymers having molecular weights (Mn) from about 10,000 to about 100,000 or higher have been found to impart also viscosity index improving properties to the final products. The use of such higher molecular weight olefin polymers is often desirable.

Preferably the substituent is derived from a polyolefin characterized by a Mn value of about 700 to about 10,000 and a Mw/Mn value of 1.0 to about 4.0.

In one method for preparing the hydrocarbon substituted acylating agents employed to prepare the compositions used in this invention, one or more of the above-described polyalkenes is reacted with one or more olefinic carboxylic acid reactants. Representative acids include maleic or fumaric reactants, such as acids or anhydrides, acrylic acid, itaconic acid, etc. Ordinarily the reactants will be the acid, the anhydride, or a mixture of two or more of these. The maleic reactants are usually preferred, and result in substituted succinic acid-producing compounds.

For convenience and brevity, the term "acidic reactant" is often used hereinafter. When used, it should be understood that the term is generic to olefinic carboxylic acid reactants. Also, the term "acylating agents" is used herein to represent the substituted acylating compounds.

One procedure for preparing the acylating agents used in this invention is illustrated, in part, in U.S. Pat. No. 3,219,666 which is expressly incorporated herein by reference for its teaching in regard to preparing acylating agents. This procedure, conveniently designated as "the two-step procedure", involves first chlorinating the olefin, olefin oligomers or olefin polymers described hereinabove until there is an average of at least about one chloro group for each molecular weight of olefinic compound. If a diluent is used in the chlorination procedure, it should be one which is not itself readily subject to further chlorination.

The second step in the two-step procedure is to react the chlorinated olefinic material with the acidic reactant. The mole ratio of chlorinated olefinic material to acidic reactant is usually about 1:1; however, a stoichiometric excess of acidic reactant can be used. If an average of more than about one chloro group per molecule of olefinic material is introduced during the chlorination step, then more than one mole of acidic reactant can react per molecule of chlorinated olefinic material. It is normally desirable to provide an excess of acidic reactants. Unreacted excess acidic reactant may be stripped from the reaction product, or reacted during a further stage as explained below. The resulting aliphatic hydrocarbon substituted acylating agent may be, optionally, again chlorinated if the desired number of succinic groups are not present in the product. Any excess acidic reactant remaining from the second step will react as additional chlorine is introduced during the subsequent chlorination. Additional acidic reactant may be introduced during and/or subsequent to the additional chlorination step. This technique may be repeated until the total number of acylating groups per equivalent weight of substituent groups reaches the desired level.

A procedure for preparing substituted succinic acylating agents utilizes a process described in U.S. Pat. No. 3,912,764 and U.K. Patent 1,440,219, both of which are expressly incorporated herein by reference for their teachings in regard to that process. According to that process, a polyalkene and a maleic reactant are first reacted by heating them together in a "direct alkylation" procedure. When the direct alkylation step is completed, chlorine is introduced into the reaction mixture to promote reaction of the remaining reactants.

Another process for preparing substituted succinic acylating agents is the so-called "one-step" process. This process if described in U.S. Pat. Nos. 3,215,707 and 3,231,587. Both are expressly incorporated herein by reference for their teachings in regard to that process. Basically, the one-step process involves preparing a mixture of the olefinic material and the acidic reactant containing the necessary amounts of both to provide the desired substituted acylating agents. Chlorine is then introduced into the mixture, while maintaining a temperature of at least about 140° C. A variation of this process involves adding additional acidic reactants during or subsequent to the chlorine introduction.

Usually, where the olefinic material is sufficiently fluid under mixing and reaction conditions, there is no need to utilize a solvent/diluent in the one-step process. However, as explained hereinbefore, if a solvent/diluent is employed, it is preferably one that resists chlorination.

In addition to the disclosures contained in the publications and patents listed hereinabove, aliphatic hydrocarbon substituted acylating agents are described in the listings of patents and other publications describing component (C), the boron and nitrogen-containing compound and component (D), the acylated nitrogen compound. Furthermore, descriptions of many useful types of acylating agents are provided in Canada Patent 1,183,125 and PCT Publication WO 85/03504 and in the following U.S. Pat. Nos.:

| | | |
|---|---|---|
| 2,962,443 | 4,061,474 | 4,203,855 |
| 3,172,892 | 4,067,698 | 4,205,960 |
| 3,341,542 | 4,090,971 | 4,216,099 |
| 3,374,174 | 4,098,708 | 4,234,435 |
| 3,444,170 | 4,110,349 | 4,285,824 |
| 3,454,607 | 4,128,488 | 4,320,019 |
| 3,502,677 | 4,131,554 | 4,343,740 |
| 3,755,169 | 4,163,730 | 4,357,250 |
| 3,787,374 | 4,176,077 | 4,471,091 |
| 3,859,318 | 4,179,449 | 4,486,573 |
| 3,868,330 | 4,186,139 | 4,489,194 |

Each of the above referred to and/or listed patents and publications is hereby expressly incorporated by reference for teachings contained therein regarding hydrocarbon substituted acylating agents.

The amines which are used to prepare the boron-nitrogen containing compositions (C) may be monoamines and polyamines. The monoamines and polyamines must be characterized by the presence within their structure of at least one H—N group. Therefore, they have at least one primary (i.e., $H_2N$—) or seconary (i.e., H—N=) amino group. The amines can be aliphatic, cycloaliphatic or heterocyclic, including aromatic substituted versions thereof. The amines may also contain non-hydrocarbon substituents or groups as long as these groups do not significantly interfere with the reaction of the amines with the acylating agents. Such non-hydrocarbon substituents have been described hereinabove.

In general the amine employed to prepare (C) may be characterized by the formula $$R_1R_2NH$$

wherein $R_1$ and $R_2$ are each independently hydrogen or hydrocarbon, amino-substituted hydrocarbon, hydroxy-substituted hydrocarbon, alkoxy-substituted hydrocarbon, amino, carbamyl, thiocarbamyl, guanyl and acylimidoyl groups provided that only one of $R_1$ and $R_2$ may be hydrogen.

With the exception of the branched polyalkylene polyamine, the polyoxyalkylene polyamines, and the high molecular weight hydrocarbyl-substituted amines described more fully hereinafter, the amines ordinarily contain less than about 40 carbon atoms in total and usually not more than about 20 carbon atoms in total.

Aliphatic monoamines include mono-aliphatic and dialiphatic-substituted amines wherein the aliphatic groups can be saturated or unsaturated and straight or branched chain. Thus, they are primary or secondary aliphatic amines.

Cycloaliphatic monoamines are those monoamines wherein there is one cycloaliphatic substituent attached directly to the amino nitrogen through a carbon atom in the cyclic ring structure.

Suitable aromatic amines include those monoamines where a carbon atom of the aromatic ring structure is attached directly to a carbon atom of an aliphatic hydrocarbon chain. The aromatic ring will usually be a mono nuclear aromatic ring but can include fused aromatic rings especially those derived from naphthalene.

Specific examples of the above-described amines are given in U.S. Pat. No. 4,234,435, which is expressly incorporated by reference for its disclosure regarding such amines.

The polyamines from which (C) is derived include principally alkylene amines conforming for the most part to the formula

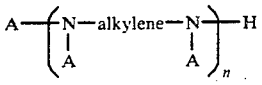

wherein n is an integer preferably less than about 10, A is hydrogen or a substantially hydrocarbon group preferably having up to about 30 carbon atoms, and the alkylene group is preferably a lower alkylene group having less than about 8 carbon atoms. Illustrative examples of such amines are given in the above-mentioned U.S. Pat. No. 4,234,435. Higher homologs such as are obtained by condensing two or more alkylene amines likewise are useful. They are described in some detail under the heading "Ethylene Amines" in "Encyclopedia of Chemical Technology", Kirk and Othmer, Volume 5, Pages 898–905, Interscience Publishers, New York (1950). This article is hereby incorporated herein by reference. Such compounds are prepared most conveniently by the reaction of an alkylene chloride with ammonia. The reaction results in the production of somewhat complex mixtures of alkylene amines, including cyclic condensation products, such as piperazines. These mixtures as well as pure alkylene amines are useful in the preparation of component (C). An especially useful alkylene amine is a mixture of ethylene amines prepared by the reaction of ethylene chloride and ammonia and having a composition which corresponds to that of tetraethylene pentamine.

Hydroxy alkyl-substituted alkylene amines (i.e., alkylene amines having one or more hydroxy alkyl substituents on the nitrogen atoms, likewise are contemplated for use herein. The hydroxy alkyl-substituted alkylene amines are preferably those in which the alkyl group is a lower alkyl group. Higher homologues such as are obtained by condensation of the above-illustrated alkylene amines or hydroxy alkyl-substituted alkylene amines through amino radicals or through hydroxy radicals are likewise useful.

Heterocyclic mono- and polyamines can also be used in making the boron and nitrogen-containing compositions (C). As used herein, the terminology "heterocyclic mono-and polyamines" is intended to describe those heterocyclic amines containing at least one primary or secondary amino group at any position in the molecule and at least one nitrogen as a heteroatom in the heterocyclic ring. Heterocyclic amines can be saturated or unsaturated and contain various substituents. Generally the total number of carbon atoms in the substituents will not exceed about 20. Heterocyclic amines can contain heteroatoms other than nitrogen, especially oxygen and sulfur, and can contain more than one nitrogen heteroatom. The five- and six-membered heterocyclic rings are preferred.

An extensive listing of specific examples of the various types of amines is presented in U.S. Pat. No. 4,234,435 which is herein expressly incorporated by reference for relevant disclosures contained therein.

The boron-containing reagent is any boron-containing compound which will react with the substituted acylating agent, the amine or with reaction products thereof. Useful boron compounds include boron oxide, boron oxide hydrate, boron trioxide, boron halides, boron acids such as boronic acid, boric acid, boron anhydrides, boron amides and various esters of such boron acids. The use of complexes of boron halides with ethers, organic acids and the like are also useful. Examples of the above-mentioned boron-containing reagents and other boron-containing reagents useful in preparation of component (C) can be found in U.S. Pat. No. 3,254,025 which is hereby incorporated by reference for its disclosure of useful boron-containing reagents.

As mentioned hereinabove, the boron-containing acylated nitrogen compound may be prepared by reacting the carboxylic acylating agent, amino compound and boron-containing reagent simultaneously or sequentially, in any order. For example, the boron-containing reagent may be first mixed with the acylating agent to which combination may be added the amino compound. Alternatively, the boron-containing reagent may be combined with the amino compound forming an intermediate product which can then be reacted with the acylating agent. A preferred method is to first form a reaction product from the acylating agent and the amine followed by post-treatment thereof with the boron-containing reagent. U.S. Pat. Nos. 3,254,025, 3,000,916, 3,087,936, 3,281,428, 3,282,955, 3,344,069, 3,449,362, 3,666,662, 4,428,849 and 4,234,435 which are herein expressly incorporated by reference, discuss procedures for preparing oil-soluble nitrogen and boron-containing materials. The general teachings of these referenced patents may be modified as noted hereinabove.

The amount of boron compound employed in the preparation of component (C) generally is sufficient to provide from about 0.1 up to about 10 atomic proportions of boron for each atomic proportion of nitrogen of said boron-containing acylating nitrogen composition. More generally, the amount of boron compound present is sufficient to provide from about 0.5 to about 2 atomic proportions of boron for each atomic proportion of nitrogen.

Reactions to prepare components (C) result in products containing boron and substantially all of the nitrogen originally present in the nitrogen reactant. The nature of the product is not clearly understood. Inasmuch as the precise stoichiometry of the complex formation is not known, the relative proportions of the reactants to be used in the process are based primarily upon the consideration of utility of the products for the purpose of this invention. In this regard, useful products are obtained from reaction mixtures in which the reactants are present in relative proportions as to provide from about 0.01 atomic proportions of boron for each mole of nitrogen to about 10 atomic proportions of boron for each atomic proportion of nitrogen. The preferred amounts of reactants are such as to provide from about 0.5 to about 2 atomic proportions of boron for each atomic proportion of nitrogen.

(D) The Acylated Nitrogen-containing Compound

In addition to components (A), (B) and (C), the lubricating compositions of the present invention may also contain a minor amount of (D) at least one acylated, nitrogen-containing compound having a total base number up to about 80, made by reacting an aliphatic hydrocarbon substituted carboxylic acylating agent having at least about 10 carbon atoms in the aliphatic hydrocarbon substituent with at least one amino compound containing at least one $$-\overset{|}{N}H$$

group, said acylating agent being linked to said amino compound through an imido, amido, amidine or acyloxy ammonium linkage. The nitrogen-containing compound (D) may be amine salts, amides, imides, imidazolines as well as mixtures thereof. They are sometimes referred to as acylated amines.

The acylated nitrogen-containing compounds useful as component (D) in the lubricating compositions of the present invention are known in the art and have been described in many U.S. Pat. Nos. including

| | | |
|---|---|---|
| 3,172,892 | 3,755,169 | 4,179,449 |
| 3,215,707 | 3,787,374 | 4,186,139 |
| 3,272,746 | 3,868,330 | 4,203,885 |
| 3,316,177 | 4,061,474 | 4,205,960 |
| 3,341,542 | 4,067,698 | 4,216,099 |
| 3,374,174 | 4,090,971 | 4,234,435 |
| 3,444,170 | 4,098,708 | 4,285,824 |
| 3,454,607 | 4,110,349 | 4,320,019 |
| 3,502,677 | 4,128,488 | 4,343,740 |
| 3,541,012 | 4,131,554 | 4,357,250 |
| 3,630,904 | 4,163,730 | 4,471,091 |
| 3,632,511 | 4,176,077 | 4,486,573 |
| | | 4,489,194 |

The above U.S. Patents are expressly incorporated herein by reference for their teachings regarding the description, use and preparation of acylated nitrogen-containing compounds.

It is emphasized that the acylated nitrogen compound will have a total base number up to about 80 and preferably from about 20 to about 50, more preferably from about 25 to about 30. The aliphatic hydrocarbon substituent has at least about 10 carbon atoms, preferably at least about 30 carbon atoms, more preferably at least about 50 carbon atoms. Often the number of carbon atoms in the hydrocarbon substituent in a particular additive will vary over some range such as from 10 to 100, 20 to 70, and the like. In such cases, the carbon numbers referred to hereinabove, i.e., at least about 10, at least about 30, etc., are to be considered as average carbon numbers.

In general, a convenient route for the preparation of the acylated nitrogen-containing compound (D) comprises the reaction of an aliphatic hydrocarbon-substituted carboxylic acylating agent with an amine containing at least one hydrogen attached to a nitrogen atom (i.e., H—N=). The hydrocarbon-substituted carboxylic acylating agents and the amines used in the preparation of component (D) are the same as those described hereinabove in the discussion of component (C), and it is not necessary to repeat the discussion here.

In general terms, the nitrogen-containing compounds (D) may be prepared by reacting one or more of the aliphatic hydrocarbon-substituted carboxylic acylating agents with one or more of the amines, both of which have been described hereinabove, optionally in the presence of a normally liquid, substantially inert organic liquid solvent/diluent at an elevated temperature generally in the range from about 80° C. up to the decomposition point of the mixture or the product. Normally, temperatures in the range of about 100° C. up to about 300° C. are utilized providing that 300° C. does not exceed the decomposition point.

The aliphatic hydrocarbon-substituted carboxylic acylating agent and the amino compound are reacted in amounts sufficient to provide at least one-half equivalent, per equivalent of acylating agent of the amino compound. Generally, the maximum amount of amine present will be about 2 moles of amine per equivalent of acylating agent. For the purposes of this invention, sufficient amine is present to provide a resulting product having a total base number up to about 80. Additional details and examples of the procedures for preparing the nitrogen-containing compound (D) which may be used in the present invention are included in the above listing of U.S. Patents, which patents are hereby expressly incorporated by reference.

The following are illustrative nonlimiting examples of the process for preparing the (C) nitrogen- and boron-containing compounds and (D) nitrogen-containing compositions useful in this invention.

EXAMPLE 5

A polyisobutenyl succinic anhydride is prepared by the raction of a chlorinated polyisobutylene with maleic anhydride at 200° C. The polyisobutenyl group has an average molecular weight of 850 and the resulting alkenyl succinic anhydride is found to have an acid number of 113 (corresponding to an equivalent weight of 500). To a mixture of 500 grams (1 equivalent) of this polyisobutenyl succinic anhydride and 160 grams of toluene there is added at room temperature 35 grams (1 equivalent) of diethylene triamine. The addition is made portionwise throughout a period of 15 minutes, and an initial exothermic reaction causes the temperature to rise to 50° C. The mixture then is heated and a water-toluene azeotrope distilled from the mixture. When no more water distills, the mixture is heated to 150° C. at reduced pressure to remove the toluene. The residue is diluted with 350 grams of mineral oil and this solution is found to have a nitrogen content of 1.6%.

EXAMPLE 6

A polypropylene-substituted succinic anhydride having an acid number of 84 is prepared by the reaction of a chlorinated polypropylene having a chlorine content of 3% and molecular weight of 1200 with maleic anhydride. A mixture of 813 grams of the polypropylene-substituted succinic anhydride, 50 grams of a commercial ethylene amine mixture having an average composition corresponding to that of tetraethylene pentamine and 566 grams of mineral oil is heated at 150° C. for 5 hours. The residue is found to have a nitrogen content of 1.18%.

EXAMPLE 7

A mixture of 1000 parts (0.495 mole) of polyisobutene (Mn=2020; Mw=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°-189° C., an additional 59 parts (0.83 mole) of chlorine is added beneath the surface. At 184°-189° C., an additional 59 parts (0.83 mole) of chlorine is added over 4 hours. The reaction mixture is stripped by heating at 186°-190° C. with nitrogen blowing for 26 hours. The residue is the desired polyisobutene-substituted succinic acylating agent having a saponification equivalent number of 87 as determined by ASTM procedure D-94.

A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the substituted succinic acylating agent at 140°-145° C. The reaction mixture is heated to 155° C. in 3 hours and stripped by blowing with nitrogen. The reaction mixture is filtered to yield the filtrate as an oil solution of the desired product.

EXAMPLE 8

To 1000 parts of poly(isobutene) substituted succinic anhydride (which is prepared by the "one-step" procedure of U.S. Pat. No. 3,215,707) having a saponification number of 108 is added 147 parts of an ethylene polyamine having an empirical formula that corresponds to pentaethylene hexamine, and 275 parts mineral oil. The reaction is begun at 90° C. and the temperature is increased to 121° C. with nitrogen blowing. The reaction mixture is stripped of volatile materials by heating to 150° C. The residue is filtered.

EXAMPLE 9

The procedure of Example 8 is followed except 700 parts of mineral oil and 54.2 parts of ethylene polyamine are used.

EXAMPLE 10

A slurry of 239 parts boric acid in 398 parts mineral oil is reacted with 1405 parts of the product of Example 8. The reaction is conducted starting at 90° C. and the temperature is increased to 150° C. over 3 hours followed by nitrogen blowing at 150°-155° C. The reaction mixture is filtered.

EXAMPLE 11

The procedure of Example 10 is repeated except 50 parts of boric acid are employed.

EXAMPLE 12

The procedure of Example 10 is followed except 1000 parts of the product of Example 8 and 63 parts of boric acid are employed.

(E) The Zinc Salt of a Carboxylic Acid

The lubricating compositions of this invention may also contain a minor amount of a zinc salt of a carboxylic acid. These zinc salts may be acidic, neutral or basic (overbased). These salts may be prepared from the reaction of a zinc-containing reagent with a carboxylic acid or salt thereof. A useful method of preparation of these salts is to react zinc oxide with a carboxylic acid. Useful carboxylic acids are those described hereinabove as component (B)(II)(2). Preferred carboxylic acids are those of the formula $R^2COOH$ wherein $R^2$ is an aliphatic or alicyclic hydrocarbon radical. Especially preferred are those acids wherein $R^2$ is a fatty group, e.g., stearyl, oleyl; linoleyl, palmityl, etc. More preferred are the zinc salts wherein zinc is present in a stoichiometric excess over the amount needed to prepare a neutral salt. Salts wherein the zinc is present from about 1.1 to about 1.8 times the stoichiometric amount, especially from 1.3 to 1.6 times the stoichiometric amount of zinc are preferred. These zinc carboxylates are known in the art and are described in U.S. Pat. No. 3,367,869, which is hereby incorporated by reference.

As indicated hereinabove, the metal salt (B) is the major source of phosphorus in the lubricating compositions of this invention. Other phosphorus-containing materials that may be used include ashless (i.e., metal free) phosphorus-containing materials. Examples of such materials include various phosphorus-containing esters such as O,O,O-trialkyl phosphates, dialkylphosphites, phosphinates, phosphonates, etc. In a preferred embodiment, except for minor, impurity amounts of ashless phosphorus-containing materials, all of the phosphorus in the lubricating composition is derived from component (B), the metal salt. In any event, the metal salt (B) contributes the major amount of phosphorus to the lubricating composition.

The lubricating compositions of this invention contain up to about 0.015% by weight phosphorus, preferably up to about 0.01% by weight. In a particularly preferred embodiment, the lubricating composition contains up to about 50 parts by weight, per million parts by weight of lubricating composition.

The lubricating compositions of this invention contain from about 0.005% to about 0.02% by weight of boron as component (C). Preferably the compositions contain from about 0.006 to about 0.01 percent by weight of boron. More preferably, the compositions of this invention contain from about 0.007 to about 0.009 percent by weight of boron.

Component (D), the acylated nitrogen-containing compound, if present, will be utilized at a level to provide from about 0.6 to about 3.0 percent by weight of component (D). Preferably component (D) is present from about 1.1 to about 2.3 percent by weight, more preferably from about 1.3 to about 1.7 percent by weight.

A single additive may provide both component (C) and component (D). For example, an acylated nitrogen-containing compound (C) may be post-treated with less than a stoichiometric amount of boron-containing reagent. The resulting product is a mixture of boronated and non-boronated acylated nitrogen-containing material.

This invention also contemplates the use of other additives in combination with the composition of the invention. Such additives include, for example, auxiliary detergents and dispersants of the ash producing or ashless type, auxiliary antioxidants, auxiliary antiwear agents, seal swell agents, pour point depressing agents, viscosity improving agents, extreme pressure agents, friction modifiers, color stabilizers and anti-foam agents. Ashless dispersants and detergents are those that are substantially metal free. Such additional additives are well known in the art and are described in detail in many of the patents and other publications incorporated herein by reference.

The following are examples of lubricating oil compositions of the instant invention. All amounts are by weight unless indicated otherwise.

EXAMPLE 13

A lubricating oil composition for automatic transmissions and power shift transmissions which meets both Dexron®II and Allison C-3 specifications which includes a base stock consisting of a mixture of mineral oils and 8% by weight of an additive concentrate consisting of:

| Additive | % by Weight |
|---|---|
| Prod. Example 8 (oil-free basis) | 17.8 |
| Mineral Oil | 50.66 |
| Example 10 (oil-free basis) | 3.18 |
| Example 1 (oil-free basis) | 0.57 |
| Alkyl aromatic triazole | 0.23 |
| Alkylated aryl amine | 1.07 |
| Hydroxyalkyl thioether | 5.62 |
| Fatty alkanol amine | 1.32 |
| Zinc carboxylate | 2.19 |
| Silicone anti-foam agent | 0.05 |
| Styrene-alkyl maleate copolymer-heterocyclic amine reactant product | 17.3 |

EXAMPLE 14

Example 13 is repeated replacing the product of Example 1 with an equal amount of phosphorus of the product of Example 4.

EXAMPLE 15

Example 13 is repeated replacing the products of Examples 8 and 10 with 11.5 parts (on an oil-free basis) by weight of the product of Example 11 and making up the difference with mineral oil.

What is claimed is:

1. A power transmission fluid containing up to about 0.015% by weight phosphorus which comprises (A) a major amount of an oil of lubricating viscosity, (B) at least one metal salt selected from the group consisting of (I) metal salts of the formula

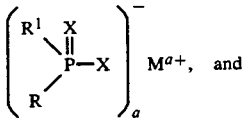

$M^{a+}$, and (II) metal salts $M_b^{a+}Y^{-}{}_a$ of a mixture of (1) at least one acid of the formula

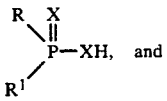

and (2) at least one carboxylic acid having the formula $R^2COOH$ wherein $R^2$ contains from about 2 to about 40 carbon atoms and is an aliphatic or alicyclic hydrocarbon-based radical, each $Y^-$ is independently an anion of acids (1) or (2), M is a metal, a is the valence of the metal M, b is a number between 0.5 and 2, P is phosphorus, each X is independently oxygen or sulfur, and R and $R^1$ are the same or different hydrocarbon groups of at least 3 carbon atoms bonded to the phosphorus, at least one bond being at a secondary carbon atom of R or $R^1$, through an oxygen or sulfur atom, and (C) from about 0.005% to about 0.02% by weight boron as at least one acylated, nitrogen-containing compound made by reacting an aliphatic hydrocarbon substituted carboxylic acylating agent having at least about 10 carbon atoms in the aliphatic hydrocarbon substituent, simultaneously or sequentially, in any order, with at least one amino compound containing at least one

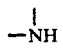

group and a boron-containing reagent, provided further (B) the metal salt is the major source of phosphorous in the lubricating composition.

2. The power transmission fluid of claim 1 wherein each of R and $R^1$ is an alkyl radical containing from 3 to about 40 carbon atoms.

3. The power transmission fluid of claim 1 wherein M is at least one of Group I metals, Group II metals, aluminum, tin, cobalt, lead, molybdenum, manganese, nickel, titanium, iron and antimony.

4. The power transmission fluid of claim 2 wherein at least one of R and $R^1$ is a branched alkyl radical.

5. The power transmission fluid of claim 2, wherein each of R and $R^1$ is bonded to the phosphorus through an oxygen atom and X is sulfur.

6. The power transmission fluid of claim 1 wherein the metal salt (B) provides substantially all of the phosphorus to the lubricating composition.

7. The power transmission fluid of claim 2 wherein each of R and $R^1$ contains from 3 to about 16 carbon atoms.

8. The power transmission fluid of claim 3 wherein the metal M is zinc.

9. The power transmission fluid of claim 7 wherein the metal M is zinc.

10. The power transmission fluid of claim 1 which further comprises a minor amount (D) at least one acylated, nitrogen-containing compound having a total base number up to about 80, made by reacting an aliphatic hydrocarbon substituted carboxylic acylating agent having at least about 10 carbon atoms in the aliphatic hydrocarbon substituent with at least one amino compound containing at least one

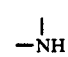

group, said acylating agent being linked to said amino compound through an imido, amido, amidine or acyloxy ammonium linkage.

11. The power transmission fluid of claim 10 wherein the boron-containing reagent is selected from the group consisting of boric acid or boric anhydride, and the aliphatic hydrocarbon substituents of components (C) and (D) each have at least about 30 carbon atoms.

12. The power transmission fluid of claim 11 wherein the substituents in components (C) and (D) are derived from poly-lower olefins.

13. The power transmission fluid of claim 12 wherein the substituents of components (C) and (D) are polyisobutylene.

14. The power transmission fluid of claim 13 wherein the total base number of component (D) is from 20 to 50.

15. The power transmission fluid of claim 13 wherein the R and $R^1$ are a mixture of isopropyl and 4-methyl-2-pentyl radicals bonded to phosphorus through an oxygen atom.

16. The power transmission fluid of claim 15 wherein X is sulfur and the metal is zinc.

17. The power transmission fluid of claim 1 wherein the aliphatic hydrocarbon substituent in component (C) has at least about 30 carbon atoms.

18. The power transmission fluid of claim 1 wherein the aliphatic hydrocarbon substituent in component (C) is derived from poly-lower olefins.

19. The power transmission fluid of claim 17 wherein R and $R^1$ have from about 3 to about 16 carbon atoms.

20. The power transmission fluid of claim 19 wherein the substituent in component (C) is polyisobutylene.

21. The power transmission fluid of claim 1 which further comprises (E), a minor amount of a zinc salt of a carboxylic acid.

22. The composition of claim 1 which contains up to about 50 parts phosphorus per million parts, by weight, of the power transmission fluid.

23. The power transmission fluid of claim 1 wherein the fluid is an automatic transmission fluid.

24. The power transmission fluid of claim 10 wherein fluid is an automatic transmission fluid.

25. The power transmission fluid of claim 21 wherein the fluid is an automatic transmission fluid.

* * * * *